United States Patent [19]

Alameddine

[11] Patent Number: 4,627,493

[45] Date of Patent: Dec. 9, 1986

[54] STEAMFLOOD RECOVERY METHOD FOR AN OIL-BEARING RESERVOIR IN A DIPPING SUBTERRANEAN FORMATION

[75] Inventor: Bassem R. Alameddine, Carrollton, Tex.

[73] Assignee: Mobil Oil Corporation, New York, N.Y.

[21] Appl. No.: 822,556

[22] Filed: Jan. 27, 1986

[51] Int. Cl.[4] ..... E21B 43/24

[52] U.S. Cl. ..... 166/263; 166/272

[58] Field of Search ..... 166/263, 268, 272

[56] References Cited

U.S. PATENT DOCUMENTS

| | | | |
|---|---|---|---|
| 3,332,485 | 7/1967 | Colburn | 166/263 X |
| 3,500,915 | 3/1970 | Fitzgerald | 166/272 |
| 3,705,625 | 12/1972 | Whitten et al. | 166/272 X |
| 3,927,716 | 12/1975 | Burdyn et al. | 166/270 |
| 4,166,502 | 9/1979 | Hall et al. | 166/272 X |
| 4,248,302 | 2/1981 | Churchman | 166/272 |
| 4,260,018 | 4/1981 | Shum et al. | 166/272 |
| 4,321,966 | 3/1982 | Traverse et al. | 166/272 X |
| 4,431,056 | 2/1984 | Shu | 166/263 |
| 4,434,851 | 3/1984 | Haynes, Jr. et al. | 166/272 |
| 4,456,066 | 6/1984 | Shu | 166/272 |
| 4,489,783 | 12/1984 | Shu | 166/263 X |
| 4,499,948 | 2/1985 | Perkins | 166/268 X |
| 4,577,691 | 3/1986 | Huang et al. | 166/272 X |

*Primary Examiner*—George A. Suchfield

*Attorney, Agent, or Firm*—A. J. McKillop; Michael G. Gilman; George W. Hager, Jr.

[57] ABSTRACT

A plurality of production wells penetrate an oil-bearing reservoir in a dipping subterranean formation. Steam injection wells are located up-dip and down-dip of each oil-bearing reservoir. Some time after steam breakthrough in the upper-most one of the production wells, this well is converted to a steam injection well, and the original up-dip steam injection well is shut in. Some time after steam breakthrough in the lower-most one of the production wells, this well is converted to a steam injection well, and the original down-dip steam injection well is shut-in. Some time after steam breakthrough occurs at the remaining up-dip and down-dip production wells, these wells are sequentially converted to steam injection wells, and the preceding up-dip and down-dip steam injection wells are shut in.

9 Claims, 1 Drawing Figure

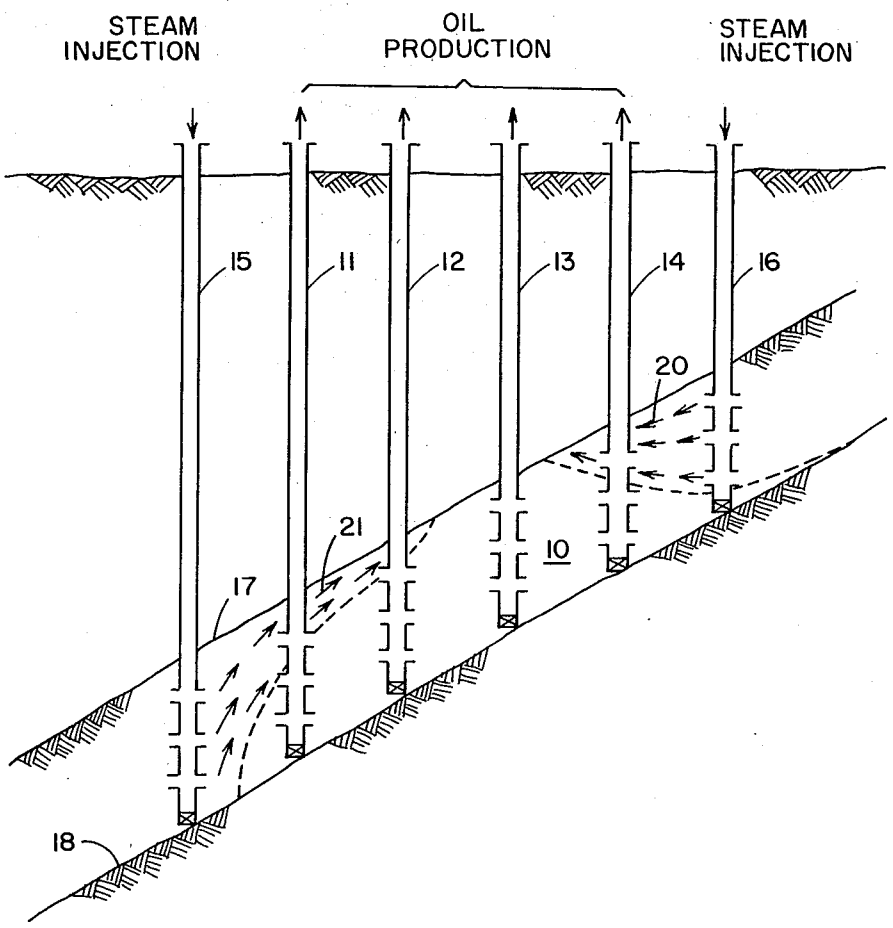
STEAM INJECTION
OIL PRODUCTION
STEAM INJECTION
16
14
13
12
11
15
20
10
21
17
18

STEAMFLOOD RECOVERY METHOD FOR AN OIL-BEARING RESERVOIR IN A DIPPING SUBTERRANEAN FORMATION

BACKGROUND OF THE INVENTION

Many oil reservoirs have been discovered which contain vast quantities of oil, but little or no oil has been recovered from many of them because the oil present in the reservoir is so viscous that it is essentially immobile at reservoir conditions, and little or no petroleum flow will occur into a well drilled into the formation even if a natural or artificially induced pressure differential exists between the formation and the well. Some form of supplemental oil recovery must be applied to these formations which decreases the viscosity of the oil sufficiently so that it will flow or can be dispersed through the formation to a production well and therethrough to the surface of the earth. Thermal recovery techniques are quite suitable for viscous oil formations, and steam flooding is the most successful thermal oil recovery technique yet employed commercially.

Steam may be utilized for thermal stimulation for viscous oil production by means of a steam drive or steam throughput process, in which steam is injected into the the formation through an injection well, to heat the formation and, in so doing, to reduce the viscosity of the oil and, possibly also, to induce a degree of cracking, resulting in a further reduction in viscosity. Processes of this type can be generally classified as basically of the two-well or one-well type. In the two-well or steam-drive type, the steam is injected through an injection well, and the injected steam serves to drive the oil towards a separate production well, which is located at some horizontal distance (offset) from the injection well. In the one-well or "huff-and-puff" type operation, a single well is used for both injection and production. The steam is first injected to reduce the viscosity of the oil and to pressurize the formation; after a certain amount of time, steam injection is terminated and the well is turned over to production. A soak period may be allowed to permit the heat to permeate the reservoir to a greater extent before production is initiated in either type of operation. Whether the process is classified as of the one-well or two-well types, the well arrangement can, of course, be repeated to cover the field in the manner desired. For example, the two-well arrangement may be repeated in regular patterns; such as, the inverted five spot or inverted seven spot patterns, as described in U.S. Pat. No. 3,927,716. The present method relates basically to the two-well type operation, using an injection well or wells and a separate production well or wells at an offset from the injection well, as described in U.S. Pat. Nos. 3,500,915; 4,431,056; and 4,456,066.

SUMMARY OF THE INVENTION

The present invention is directed to a method for accelerating the rate of oil production from an oil-bearing reservoir within a dipping subterranean formation. The dipping formation is penetrated with a plurality of production wells. Steam is injected into the formation up-dip of the production wells to heat the oil-bearing reservoir within the formation. The rate of heat communication to the oil-bearing reservoir is accelerated by co-injecting steam into the dipping formation down-dip of the production wells. The up-dip steam injection exhibits a gas cap effect on the oil-bearing reservoir, while the down-dip steam injection exhibits a fluid drive with override effect on the oil-bearing reservoir. The point of down-dip steam injection may be moved in the up-dip direction to accelerate the rate of heat communication to the production wells in the up-dip direction. In a further aspect, the point of up-dip steam injection may also be moved in the down-dip direction to accelerate the rate of heat communication to the production wells in the down-dip direction. This moving of the down-dip and up-dip steam injection points may include the conversion of those production wells that have exhibited earliest steam breakthrough into steam injection wells.

BRIEF DESCRIPTION OF THE DRAWING

The sole drawing illustrates a viscous, oil-bearing reservoir in a dipping subterranean formation which is penetrated by a plurality of production wells, an up-dip steam injection well, and a down-dip steam injection well for use in carrying out the enhanced oil recovery method of the present invention.

DESCRIPTION OF THE PREFERRED EMBODIMENT

In accordance with the present invention, there is provided an enhanced steam flood recovery method for a viscous, oil-bearing reservoir in a dipping subterranean formation.

Referring now to the drawing, there is shown an oil-bearing reservoir 10 located within the dipping subterranean formation interfaces 17 and 18. A plurality of production wells 11–14 penetrate reservoir 10 from the surface of the earth. Steam is injected into the reservoir up-dip of these production wells through a steam injection well 16. Steam flows out of injection well 16, as indicated by arrows 20, and heats the upper portion of reserovir 10 in the vicinity of production well 14. As the steam condenses and gives up its heat to the viscous oil in the reservoir, the viscosity of the oil is reduced to allow the oil to more readily flow toward production well 14 through which it is transported to the surface of the earth.

It is a specific feature of the present invention to co-inject steam down-dip from the production wells 11–14 through a steam injection well 15. Steam flows out of injection well 15, as indicated by the arrows 21, and heats the lower portion of reservoirs 10 in the vicinity of production well 11, thereby reducing the viscosity of the oil to allow the oil to more readily flow toward production well 11 through which it is transported to the surface of the earth. This steam co-injection technique of the present invention serves to enhance oil recovery in the following manner. The up-dip steam injection exhibits a gas cap effect on the oil-bearing reservoir while the down-dip steam injection exhibits a fluid drive with override effect on the oil-bearing reservoir. This combination of a gas cap effect of the up-dip steam injection and a fluid drive with override effect of the down-dip steam injection accelerates the breakthrough of steam, particularly in the lower portion of the oil reservoir. This accelerated steam breakthrough provides a faster growth of the steam zones surrounding the oil in the reservoir, thereby enhancing the rate of heat communication between the steam injection wells and the production wells. This accelerated steam breakthrough is not to be considered detrimental as it might in some steam injection schemes. To the contrary, the growth of the steam zone around the production well serves to enhance the rate of heat build-up at the production well so as to lead to the continued production of oil from such well.

Some period of time after steam breakthrough at production well 14, steam injection is moved in a down-dip direction from injection well 16 so as to accelerate the heating of the oil reservoir in the vicinity of the next lower-most production well 13. This is preferably carried out by shutting-in injection well 16 and converting, preferably, the nearest production well 14 to a steam injection well. Likewise, some time after steam breakthrough at production well 11, steam injection is moved in an up-dip direction from injection well 15 so as to heat the oil reservoir in the vicinity of the next upper-most production well 12. This is, preferably, carried out by shutting-in injection well 15 and converting the nearest product well 11 to a steam injection well.

By advancing the up-dip steam injection point in the down-dip direction through the sequential conversion of production wells to injection wells, and by advancing the down-dip steam injection point in the up-dip direction through the sequential conversion of production wells to injection wells, the entire oil reservoir is produced. However, such conversion of the up-dip production wells to injection wells need not be as frequent as the conversion of the down-dip production wells to injection wells.

Such an early shut-down of some of the up-dip and down-dip production wells to achieve accelerated heat communication to the remaining production wells does not diminish the amount of oil recovery, but instead enhances the overall recovery rate. The point in time at which an up-dip or down-dip production well is converted to an injection well is not dependent solely on an early steam breakthrough at such well. One consideration is the economic viability of continuing to produce the well. Another consideration is the amount of the reservoir that has been heated and how much oil has been displaced in the space between the well and the nearest injection well.

Even though there is severe override and breakthrough of the down-dip injected steam, as indicated by arrows 21 near production well 11, the reservoir is heated much more rapidly than with a down-dip hot water drive. In fact, it is the use of this severe down-dip override effect in combination with the up-dip gas cap effect that provides for the enhanced oil recovery of the present invention.

The quality of the steam injections of the present invention is, preferably, in the range of 60 to 80 percent and the temperature of such steam is, preferably, in the range of 350° to 600° F.

Having now described the method of the present invention, it is to be understood that various modifications and alterations may be made without departing from the spirit and scope of the invention as set forth in the appended claims.

I claim:

1. A method for enhancing the rate of oil production from an oil-bearing reservoir within a dipping subterranean formation, comprising the steps of:

(a) penetrating said dipping formation with a plurality of production wells, (b) injecting steam into said dipping formation above the upper-most one of said production wells to heat the oil-bearing reservoir within said formation, and (c) co-injecting steam into said dipping formation below the lower-most one of said production wells, the injection of steam above the upper-most production well exhibiting a gas cap effect on the oil-bearing reservoir and the injection of steam below the lower-most production well exhibiting a fluid drive with an override effect on the oil-bearing reservoir, thereby increasing the growth rate of steam surrounding said reservoir and accelerating the rate of heat communication to said reservoir.

2. A method for enhancing production from an oil-bearing reservoir within a dipping subterranean formation, comprising the steps of:

(a) penetrating said dipping formation with a plurality of production wells, (b) creating a cap effect on the up-dip portion of said oil-bearing reservoir by the injection of steam into said dipping formation up-dip of said upper-most production well, (c) creating a fluid drive with override effect on the down-dip portion of said oil-bearing reservoir by the injection of steam into said formation down-dip of said lower-most production well, (d) moving the point of said up-dip steam injection in a down-dip direction, and (e) moving the point of said down-dip steam injection in an up-dip direction, whereby the increased growth rate of steam surrounding said oil-bearing reservoir accelerates the rate of heat communication to the reservoir and enhances the rate of oil recovery from said reservoir.

3. A method for enhancing oil production from an oil-bearing reservoir in a dipping subterranean formation through steam injection, comprising the steps of:

(a) penetrating the oil-bearing reservoir within said dipping formation with a plurality of production wells, (b) injecting steam into said dipping formation through injection wells located up-dip of said production wells, said up-dip steam injection creating a gas cap effect on the up-dip portion of said oil-bearing reservoir, (c) co-injecting steam into said dipping formation through injection wells located down-dip of said production wells, said down-dip steam injection creating a gas override effect on the down-dip portion of said oil-bearing reservoir, and (d) moving the point of said down-dip steam injection in the up-dip direction so as to accelerate the rate of heat communication to said production wells in the up-dip direction, thereby accelerating the time of steam breakthrough at said production wells which, in turn, enhances the growth rate of steam surrounding said oil-bearing reservoir.

4. The method of claim 3 further comprising the step of moving the point of said up-dip steam injection in the down-dip direction so as to accelerate the rate of heat communication to said production wells in the down-dip direction.

5. The method of claim 4 wherein the steps of moving the up-dip and down-dip steam injection points includes the conversion of select ones of the up-dip and down-dip production wells to steam injection wells.

6. The method of claim 5 wherein said select production wells are those production wells which have exhibited steam breakthrough.

7. A method for the recovery of oil from a dipping subterranean viscous oil-bearing formation comprising the steps of:

(a) penetrating said formation with a plurality of spaced-apart production wells, (b) penetrating said formation with a first upper injection well located up-dip from said production wells, (c) penetrating said formation with a first lower injection well located down-dip from said production wells, (d) co-injecting steam into both the upper and lower portions of said formation through said first upper and lower injection wells, (e) producing oil through said plurality of production wells, and (f) individually converting said production wells to steam injection wells after steam breakthrough at each of said production wells.

8. The method of claim 7 wherein the step of individually converting said production wells to injection wells comprises the steps of:

(a) terminating oil production through the nearest down-dip production well from said first upper injection well after steam breakthrough at said nearest down-dip production well, (b) converting said nearest down-dip production well into a second upper injection well, (c) shutting-in said first upper injection well, (d) terminating oil production in the nearest up-dip production well from said first lower injection well after steam breakthrough at said nearest up-dip production well, (e) converting said nearest up-dip production well into a second lower injection well, and (f) shutting-in said first lower injection well.

9. The method of claim 8 wherein steps (a)-(f) are repeated until the last of said production wells exhibits steam breakthrough.

* * * * *